US006964172B2

(12) United States Patent
Dudley et al.

(10) Patent No.: US 6,964,172 B2
(45) Date of Patent: Nov. 15, 2005

(54) ADAPTIVE DEFROST METHOD

(75) Inventors: Eliot W. Dudley, Cato, NY (US); David M. Smith, Fayetteville, NY (US)

(73) Assignee: Carrier Corporation, Farmington, CT (US)

( * ) Notice: Subject to any disclaimer, the term of this patent is extended or adjusted under 35 U.S.C. 154(b) by 12 days.

(21) Appl. No.: 10/785,339

(22) Filed: Feb. 24, 2004

(65) Prior Publication Data

US 2005/0183427 A1 Aug. 25, 2005

(51) Int. Cl.[7] ..... F25D 21/08
(52) U.S. Cl. ..... 62/80; 62/151; 62/276
(58) Field of Search ..... 62/80, 151, 155, 62/156, 234, 275, 276

(56) References Cited

U.S. PATENT DOCUMENTS 4,392,358 A * 7/1983 Hicks ..... 62/155
4,432,211 A * 2/1984 Oishi et al. ..... 62/155
4,723,414 A * 2/1988 Hurutachi et al. ..... 62/155
5,295,361 A * 3/1994 Novak et al. ..... 62/128
5,950,439 A * 9/1999 Peterson et al. ..... 62/80
2003/0131614 A1 * 7/2003 Jeong ..... 62/156
2004/0244389 A1 * 12/2004 Denvir ..... 62/156

* cited by examiner

*Primary Examiner*—William E. Tapolcai
(74) *Attorney, Agent, or Firm*—Wall Marjama & Bilinski LLP

(57) ABSTRACT

The accumulation period between defrost cycles of a refrigeration apparatus having a electrical defrost heater is calculated on the basis of energy expended to remove the ice from the coil during the previous defrost cycle. In this way, variations in the voltage level being delivered to the heater coil are taken into account and the degree of ice build-up on the coil between defrost cycles can be more accurately controlled.

16 Claims, 5 Drawing Sheets

ADAPTIVE DEFROST METHOD

BACKGROUND OF THE INVENTION

This invention relates generally to controlling defrost of evaporator coils and, more particularly, to an adaptive method of defrosting evaporator coils of a transport refrigeration system.

Transport vehicles that transport temperature sensitive cargo include a conditioned space whose temperature is controlled within a predetermined temperature range. The temperature control unit can be programmed to cool or heat the conditioned space to the thermal set point.

When in the cooling mode the temperature control unit is prone to a build-up of frost on the evaporator coil. Such frost, or eventually ice, can substantially decrease the efficiency of the unit, and therefore defrost cycles are typically applied to remove the condensate/ice. A defrost cycle can be accomplished by reversing the flow of refrigeration through the system so as to circulate a heated fluid through the evaporator coil. It may also be accomplished with the use of an electrical resistance heater. After each periodic defrost cycle, the temperature control unit is returned to operate in the cooling mode until the build-up of condensation again requires a defrost cycle.

Generally, one would like to maximize the cooling cycle times and minimize the defrost cycle times. That is, since the time during defrost represents time in which the conditioned space is not being cooled, and since following defrost, it is necessary to not only make up for the heating of the conditioned space but also to cool the evaporator coil itself after being heated up by the defrost cycle, it is preferable to wait as long as possible to initiate the defrost cycle. However, the loss of efficiency as caused by a build-up of frost on the coil, will eventually necessitate the defrost cycle being initiated. Thus for any particular unit, the times in which the defrost cycle is initiated can be optimized by determining how much condensate will be built up before initiation of the defrost cycle. Generally, because of rather stable operating conditions and parameters (i.e. fixed conditioned space temperature, fixed compressor operator speed, and fixed voltage to the resistance heater), this optimum build-up of frost is directly related to operating time and, once stabilized, one can simply, and quite consistently, initiate the defrost cycle after a predetermined time in which the compressor has run since the last defrost cycle.

In some applications however, the operating parameters of the accumulation interval are not necessarily constant. For example, in the case of refrigerated containers that are loaded on a transport ship: the payload of the container may need to be cooled-down immediately after being loaded; the humidity level inside the container may change according to characteristics of the load or according to varying temperature and humidity of air introduced into the container for the purposes of venting the cargo; and the intensity of the cooling and therefore the temperature of the evaporator coil may change according to changes in cooling demand due to diurnal cycles, weather, or changes in climate along the course of the voyage.

It has long been appreciated that adapting to changes in operating parameters may be accomplished by observing the time required to defrost the unit, comparing this time to a previously determined ideal time, and adjusting the accumulation interval to be longer or shorter according to whether the defrost time is less or greater than the ideal time.

In some applications however, the operating parameters are not necessarily constant. For example, in the case of refrigerated containers that are loaded on a transport ship, the containers are powered from the ship's system, which is not consistent in providing power at a fixed level because of the number of different power units that are periodically brought online or offline. Since the wattage varies with the square of the voltage of the ships power, the amount of heat delivered by the electrical resistance heater can vary substantially over a given period of time. This, in turn, can shorten or extend the time needed for defrost.

SUMMARY OF THE INVENTION

Briefly, in accordance with one aspect of the invention, the condensate accumulation interval is calculated as a function of the previous defrost interval and also on the basis of the wattage of the heaters used in the defrost cycle. In this way, the effect of the variable heat or voltage is taken into account so as to thereby optimize the selection of a condensate accumulation interval and thereby improve the efficiency of the system.

By another aspect of the invention, provision is made to periodically sense the voltage being supplied to the evaporator heater element such that both the incremental and accumulated wattage over the period of the defrost cycle can be calculated. From the total energy expended during the defrost, the amount of ice melted can then be calculated. This value can then be used in calculating the accumulation interval for the next defrost cycle.

In accordance with another aspect of the invention, the current rate of frozen condensate accumulation is calculated on the basis of the amount of ice melted during the defrost cycle and the compressor run time since the previous defrost cycle. A new accumulation interval is then calculated on the basis of the current rate of condensate accumulation and a predetermined maximum allowable mass of frozen condensate.

In the drawings as hereinafter described, a preferred embodiment is depicted; however, various other modifications and alternate constructions can be made thereto without departing from the true spirit and scope of the invention.

DESCRIPTION OF THE PREFERRED EMBODIMENT

Figure 1:
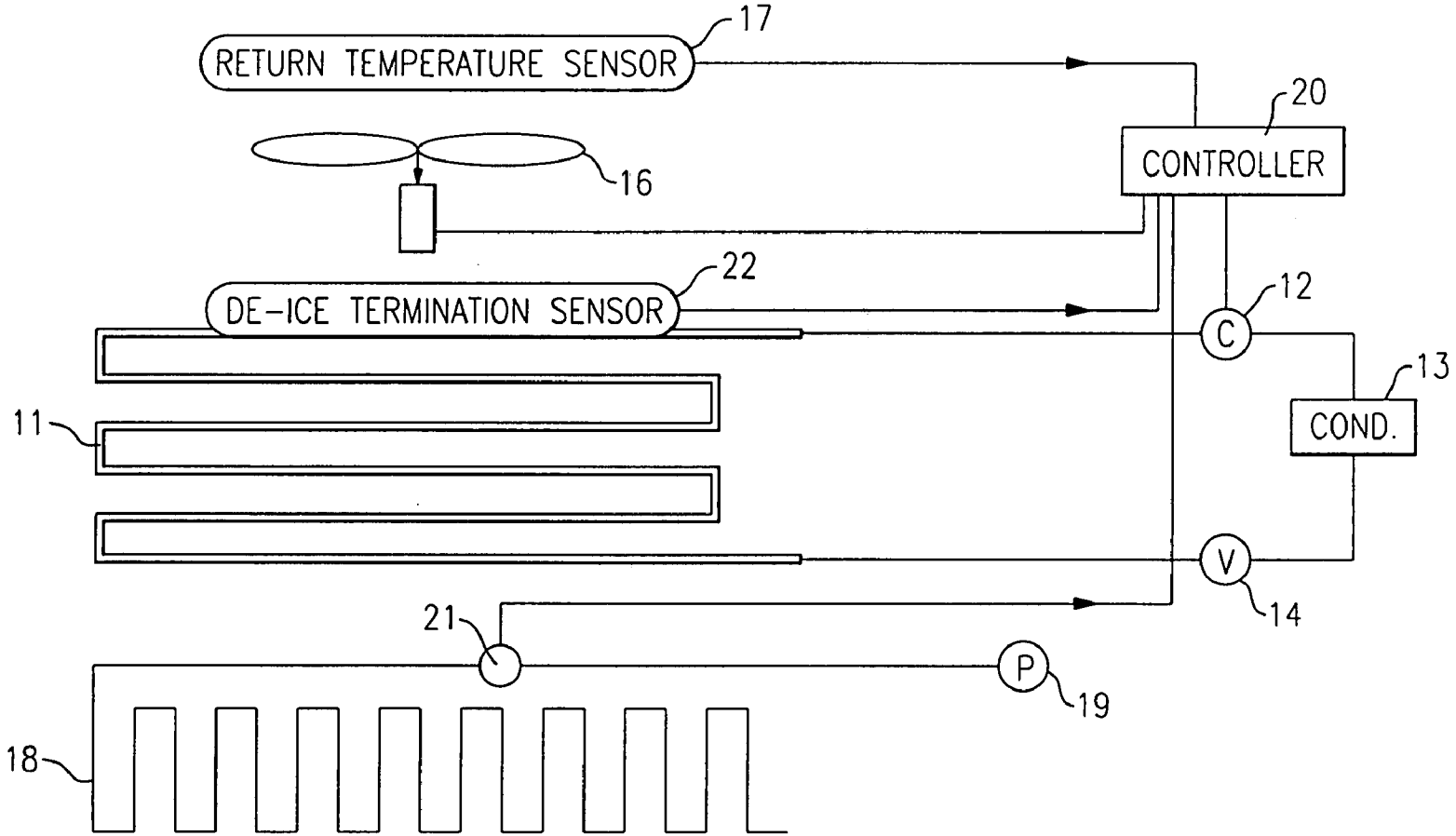
FIG. 1 is a schematic illustration of a refrigeration apparatus in accordance with one embodiment of the present invention.

Referring now to FIG. 1 there is shown an evaporative cycle portion of a refrigeration apparatus which includes an evaporator coil 11 a compressor 12 a condenser 13 and an expansion device 14, all in a conventional circuit through which a refrigerant is circulated in a conventional manner.

An evaporator fan 16 is provided for moving air from the temperature controlled space, through the evaporator coil 11 and back into the temperature controlled spaced. A return air temperature sensor 17 is provided to sense the actual temperature of the air stream returning to the evaporator coil 11 from the temperature controlled air space. This temperature, which is preferable held at or near the return air set point temperature, is used in the control process as will be described hereinafter.

As is commonly known, operation of the evaporative cycle unit causes condensate to form on the evaporator coil 11, with a condensate freezing and tending to build-up on the coil to reduce its effectiveness in cooling the air flowing therethrough. An electrical resistance heater 18 is therefore provided to periodically be turned on to melt the ice that is formed on the evaporator coil 11. The electrical resistance heater 18 receives its electrical power from a power source 19 which tends to vary in voltage level and thereby also substantially vary the wattage of the electrical resistance heater 18, both from one defrost cycle to another and also during any one defrost cycle. For that reason, a voltage sensor 21 is provided in the line from the power source 19 so as to periodically sense the voltage level. In practice, the voltage is sensed, and the wattage of the electrical resistance heater 18, is calculated every second during defrost cycle operation. Control of the system is maintained by a central processor-based controller 20 that receives inputs from the voltage sensor 21, return air temperature sensor 17, the evaporator fan 16, and also from a defrost termination temperature sensor 22 that is attached to the evaporator coil 11. It is the function of the defrost termination temperature sensor 22 to measure the temperature of the evaporator coil in order to determine when the defrost cycle is complete.

Figure 2A:
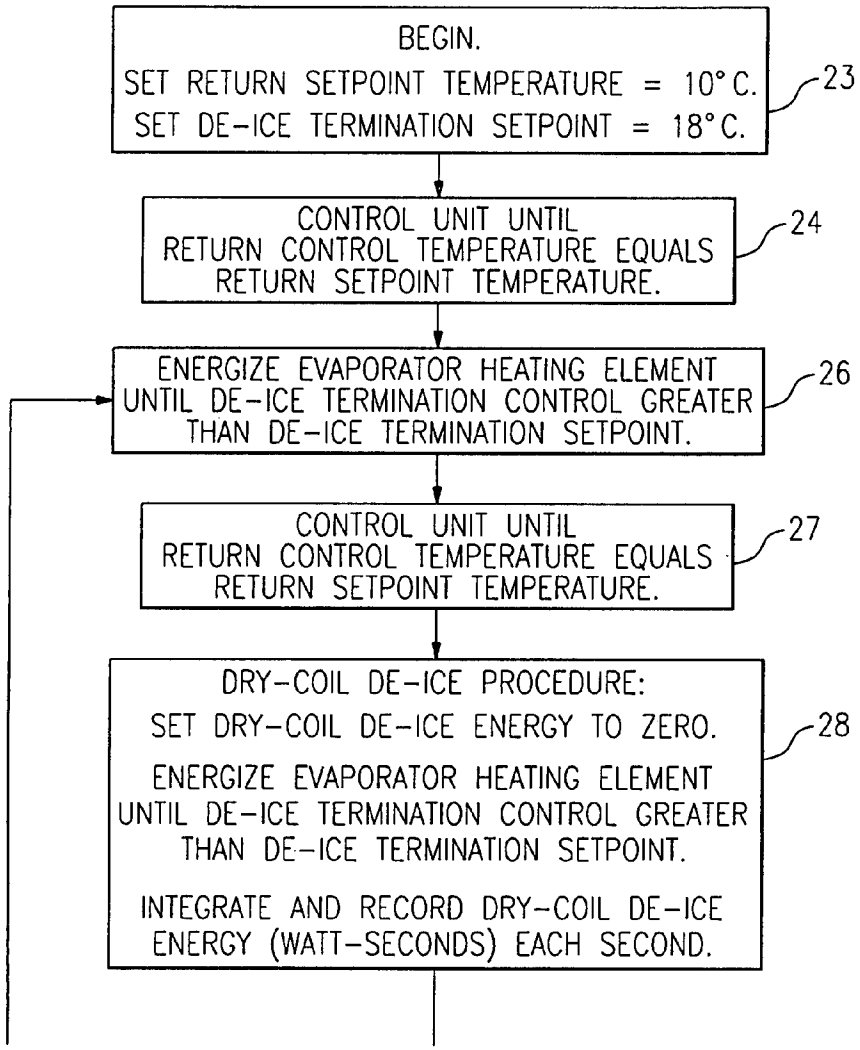
FIGS. 2A and 2B illustrate a flow chart showing the process for characterizing a dry evaporator coil de-ice energy in accordance with the present invention.
Figure 2B:
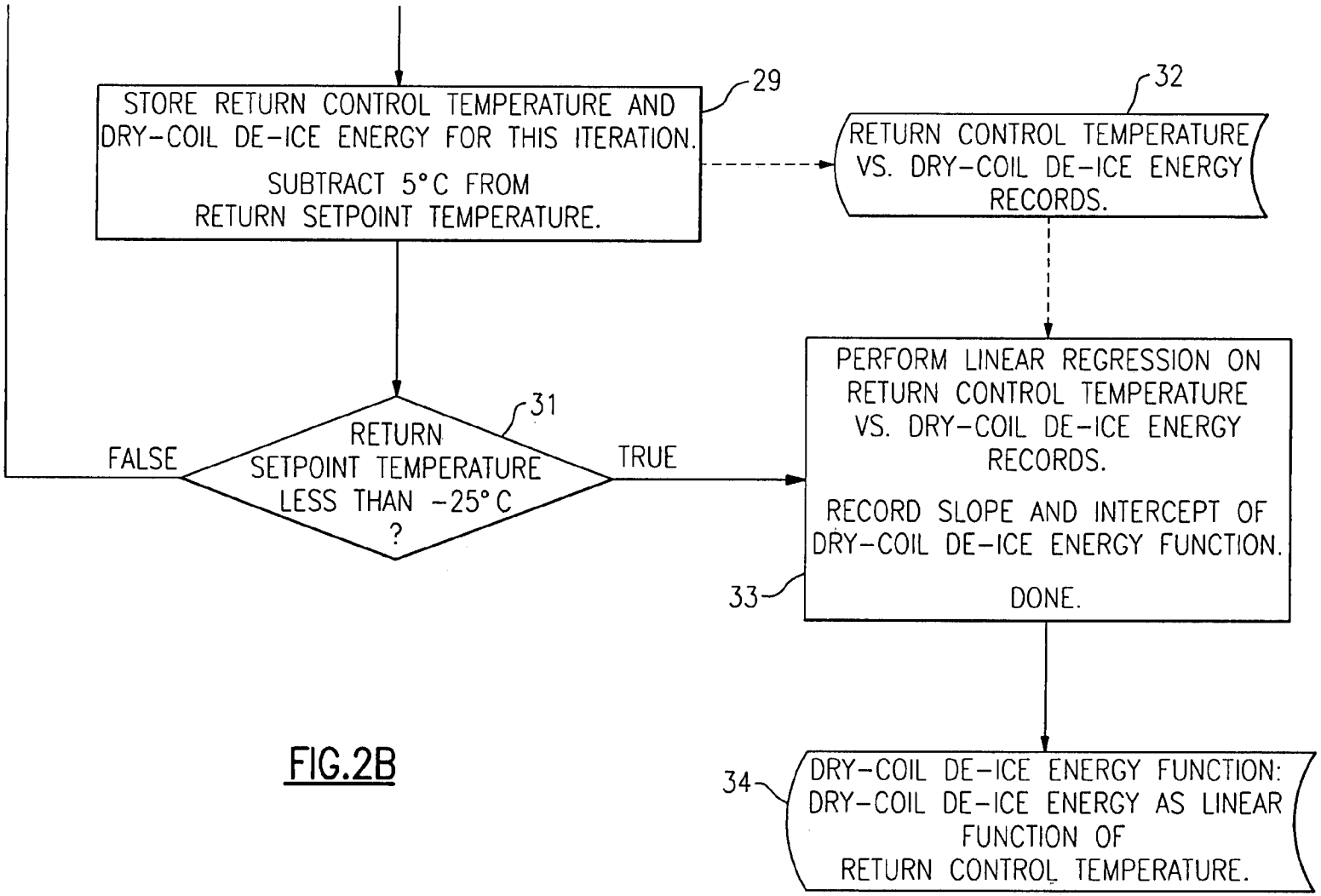

In normal operation, the defrost cycle is continuous for a period of time after it commences. The cooling cycle, on the other hand, tends to be cycled on and off, with the controller 20 turning the compressor 12 on and off as necessary to provide the desired temperature in the controlled space. It should be recognized, however, that when the defrost cycle is turned on, the cooling cycle is turned off. Accordingly, during defrost cycle operation, not only is the air to the controlled space not being cooled, but the evaporator coil 11 also is being heated. The heat that is transferred to the evaporator coil 11 by the electrical resistance heater 18 includes not only that required to melt the ice that is formed on the evaporator coil, but also includes the heat that is transferred to the evaporator coil 11 itself. This heat is referred as the dry-coil de-ice energy, and is the energy required to "de-ice" a dry evaporator coil or the amount of energy required to complete a de-ice procedure when there is no ice on the evaporator coil. The procedure for characterizing the dry-coil de-ice energy function, (i.e. the energy in kilowatt hours as a function of the temperature of the controlled space) is shown in FIGS. 2A and 2B over a range of temperatures ranging from 10° centigrade down to −25° centigrade for the return air set point temperature. The de-ice termination set point is arbitrarily set at 18° C. which is a reasonably common value for such a system. These values are established in block 23. As indicated in block 24, the unit is then operated in the cooling mode until the return air control temperature equals the return air set point temperature, after which the defrost mode is energized in block 26 until the defrost termination control (i.e. the actual temperature of the de-ice termination sensor 22) is greater than the de-ice termination set point. In block 27, the unit is then run in the cooling mode until the return air control temperature equals the return air set point temperature.

As set forth in block 28, the dry-coil de-ice procedure is then initiated by first setting the dry-coil de-ice energy to zero and then energizing the heating element 18 until the de-ice termination control temperature is greater then the de-ice termination set point. The dry-coil de-ice energy in watts seconds is then integrated and recorded each second. In block 29, the return air control temperature and dry-coil de-ice energy is stored for that iteration.

The return air set point temperature is then reduced to 5° centigrade, and the same process is repeated to obtain data for that temperature. This continues at 5° intervals down to −25° centigrade as set forth in block 31.

The resulting data is then recorded for later use as set forth in block 32. In block 33, a linear regression is performed on the return air control temperature versus the dry-coil de-ice energy function, and that result is recorded for later use. The slope and intercept of the dry-coil de-ice energy function is then recorded, and in block 34 the dry-coil de-ice energy is stored as a linear function of the return air control temperature.

Figure 3A:
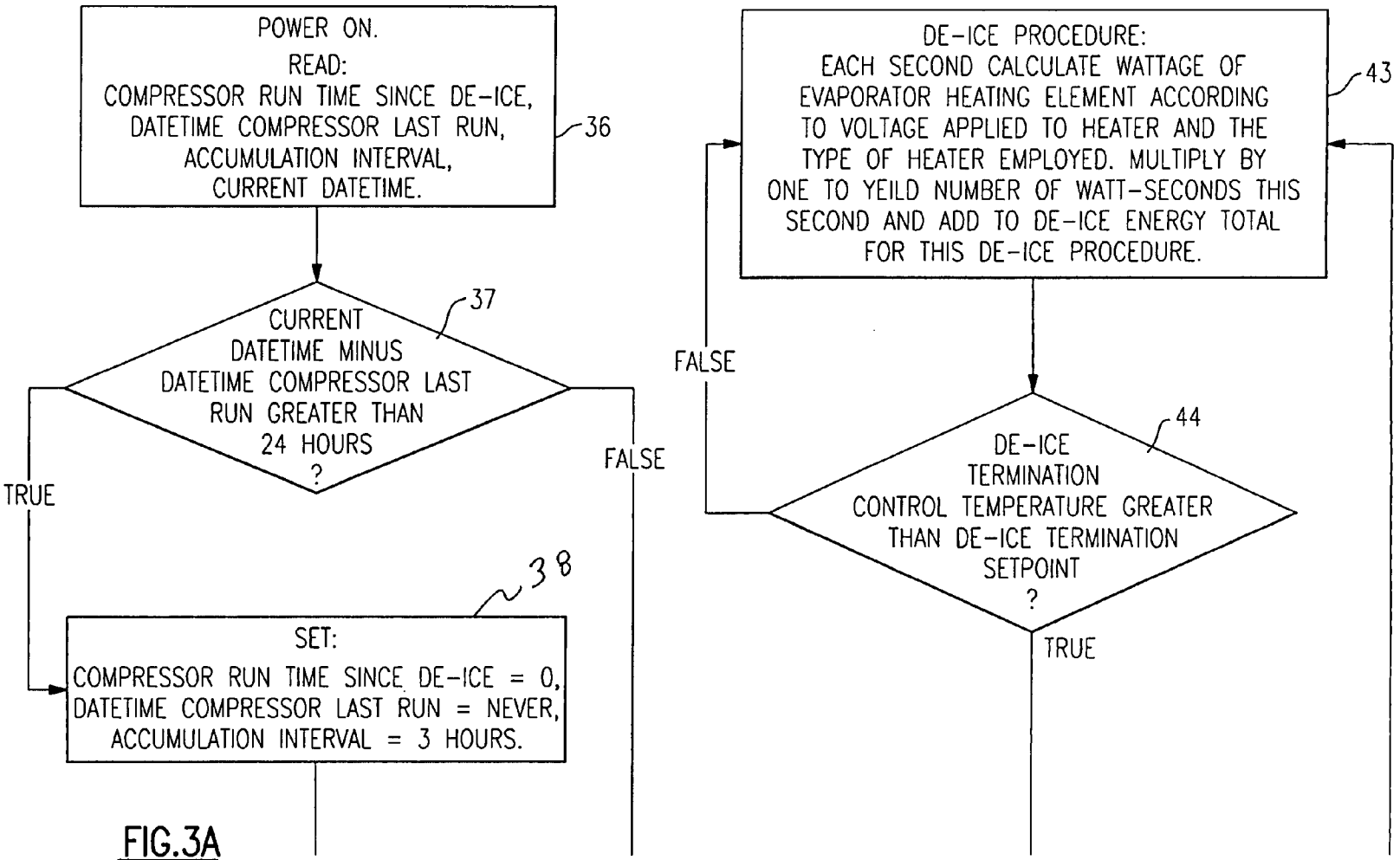
FIGS. 3A and 3B illustrate a flow chart showing the adaptive defrost cycle control method in accordance with the present invention.
Figure 3B:
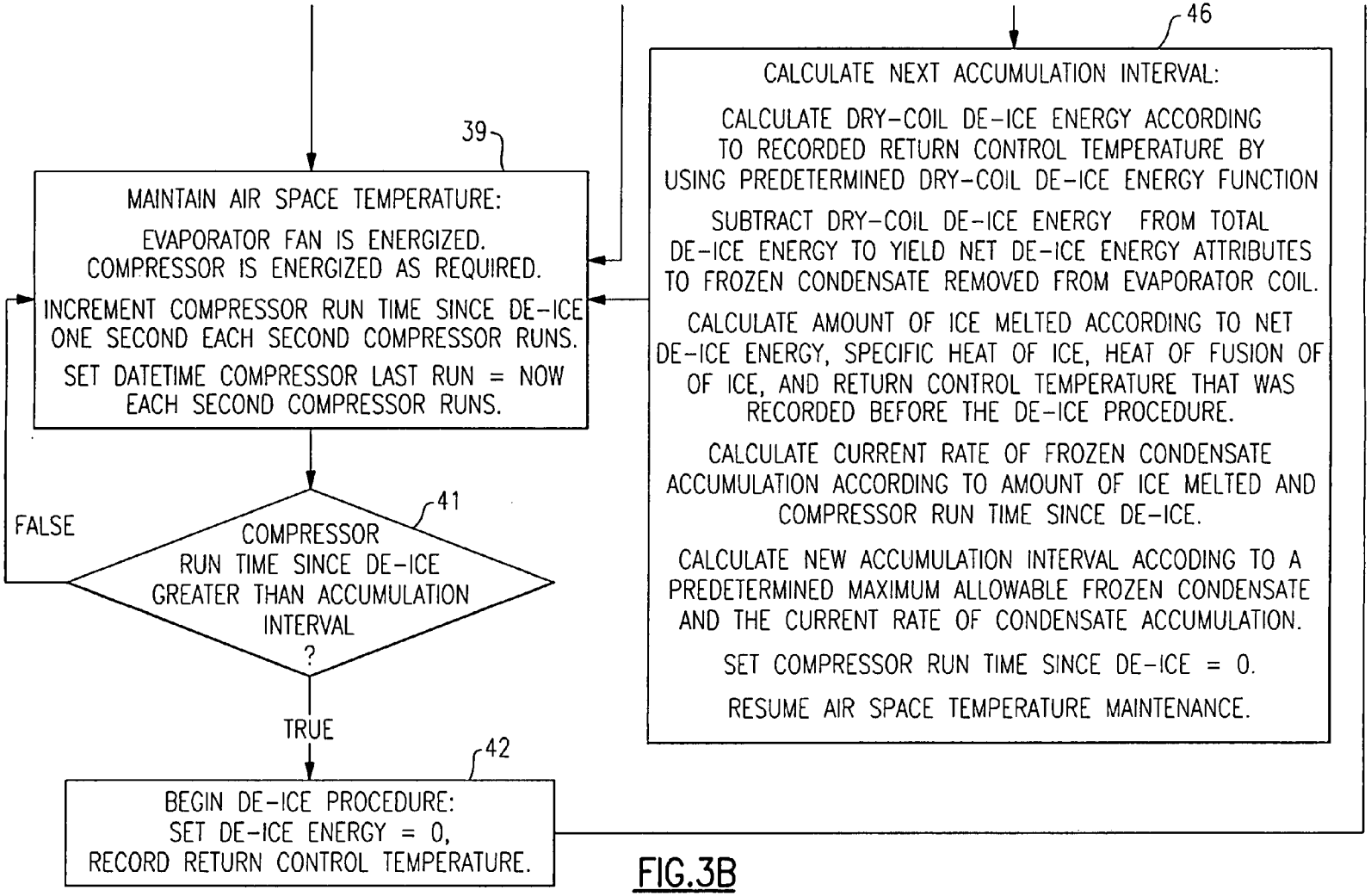

Referring now to FIGS. 3A and 3B, the adaptive defrost cycle control method is illustrated. Initially the power is turned on and the readings of compressor run times since last de-ice, the time when the compressor was last run, the accumulation interval, and the current date and time are taken in block 36. If the time since the compressor was last run is less than 24 hours as set forth in block 37, then the program proceeds to block 39. If it is greater than 24 hours, then the values are set as shown in block 38, with the accumulation interval being arbitrarily set at three hours.

In block 39, the compressor and evaporator fan are energized to commence the cooling cycle, with the compressor run time being recorded at one second increments. As provided in block 41, if the compressor run time since the last de-icing operation is less than the accumulation interval, then the program returns to block 39. If it is greater than the accumulation interval then it moves to block 42 wherein the defrost or de-ice procedure is initiated.

As shown in block 43, during the defrost procedure the voltage is sensed and the wattage calculated for each second of operation. This continues until the de-ice termination control temperature is greater than the de-ice termination set point as shown in block 44, and the resulting data is used to calculate the next accumulation interval as shown in block 46. Here, the dry coil de-ice energy is first calculated by using the dry-coil de-ice energy function as determined in those steps shown in FIGS. 2A and 2B. The dry-coil de-ice energy is then subtracted from the total de-ice energy that has been calculated in block 43 to obtain the net de-ice energy attributable to removal of the frozen condensate from the evaporator coil. Next, the amount of ice melted by the net de-ice energy is calculated on the basis of specific heat of ice, heat of fusion of ice, and the return air control temperature that was recorded before the de-ice procedure was performed. Next, the current rate of frozen condensate accumulation is calculated on the basis of the amount of ice that was melted and the compressor run time. Finally, a new accumulation interval is calculated by assuming the current rate of condensate accumulation, and a predetermined maximum allowable weight of frozen condensate.

EXAMPLE

Having described the process of calculating a new accumulation interval, we will now work through an example of that process with the following parameters being applied:

| Parameter | Application Specific? | Value |
|---|---|---|
| Default ACCUMULATION INTERVAL | Yes | 180 minutes |
| Maximum allowable frozen condensate | Yes | 9 kg |
| DRY-COIL DE-ICE ENERGY FUNCTION | Yes | 0.9 kW-hr-(0.0190 RETURN CONTROL TEMPERATURE ° C.) |
| DE-ICE TERMINATION SETPOINT | Yes | 18° C. |
| EVAPORATOR HEATING ELEMENT wattage | Yes | 3.167 kW @ 460 VAC |
| Heat of fusion of water | No | 0.09266 kW-hr/kg |
| Specific heat of ice | No | 0.0005813 kW-hr/kg/° C. |

Power On:

If we suppose that current datetime minus datetime compressor last run is greater than 24 hours, then current accumulation interval=180 minutes, compressor run time since=0.

Begin Cycle:

After the compressor has run for the accumulation interval (180 minutes the first time through in this example), begin de-ice procedure. Set de-ice energy=0, energize evaporator heating element. Suppose that a return control temperature of −3.0° C. is recorded just before de-ice procedure is begun.

For each second during the de-ice procedure, the voltage to the evaporator heating element is measured. For the purpose of simplifying this example, suppose that the voltage is a constant 480VAC throughout the procedure; therefore the heater wattage would be constant. Nevertheless, a claim of this application is that instantaneous wattage is calculated with sufficient frequency so as to make possible a valid method for integrating power over an interval of time in cases where heater voltage varies during the de-ice procedure. Thus the total amount of energy introduced during the de-ice procedure is measured with sufficient accuracy to arrive at a useful estimate of the frozen condensate accumulated, as calculated below.

Since the heating power of a resistive heating element varies as the square of the voltage applied, and if the wattage of the heater in this example is 3.167 KW at 460 VAC, then at 480 VAC the wattage would be (3.167 kW)×((480×480)/(460×460)), or 3.448 kW. If we suppose that the de-ice procedure lasts 1260 seconds (21 minutes), the de-ice energy would be (3.448×1260) kW-seconds, or 1.207 KW-hr.

Dry-coil de-ice energy is calculated to be (0.9 kW-hr−(0.0190×−3.0)), or 0.957 kW-hr, according to the dry-coil de-ice energy function above. Net de-ice energy attributable to frozen condensate removed from evaporator-coil is therefore (1.207−0.957) kW-hr, or 0.25 kW-hr.

This net de-ice energy attributable to frozen condensate removed from evaporator-coil is assumed to be equal to the amount of energy needed to raise the temperature of the ice from −3.0° C. up to 0.0° C., plus the energy needed to melt the ice. Those knowledgeable in the art would point out that the return control temperature is necessarily higher than the actual temperature for the frozen condensate when the de-ice procedure is initiated, but this fact is ignored and doing so does not materially diminish the validity of the method described herein.

The amount of frozen condensate is therefore give by the formula:

kg ice=net de-ice energy/

((0.0° C.—return control temperature)×specific heat of ice)+(heat of fusion) which in this example would be (0.25)/((3.0×0.0005812)+0.09266), or 2.648 kg. In cases where the return control temperature is greater than 0.0° C. the condensate is assumed to be at or near 0.0° C. and therefore the term accounting for the specific heat of ice is ignored.

The prior accumulation interval was 180 minutes; therefore the accumulation rate is (2.648 kg/180 min), or 0.0147 kg per minute.

The maximum accumulation is predetermined according to testing and observations carried out by the manufacturer of the unit. This amount is biased to achieve a somewhat sub-optimally short accumulation interval as opposed to the greater evil of risking an unacceptably large condensate accumulation. The next accumulation interval should be just long enough to accumulate 9 kg of frozen condensate in this example. At the current rate of accumulation, 9 kg of accumulation would take 612 minutes, so the accumulation interval is set to 10 hours and 12 minutes, compressor run time since de-ice is reset to 0 and the cycle repeats, but this time with a new accumulation interval.

While the present invention has been particularly shown and described with reference to preferred and alternate embodiments as illustrated in the drawings, it will be understood by one skilled in the art that various changes in detail may be effected therein without departing from the spirit and scope of the invention as defined by the claims.

We claim:

1. A method of determining the accumulation interval between a first defrost cycle and a second defrost cycle in a refrigeration apparatus having an evaporator coil and an electrical defrost heater for applying heat to the evaporator coil during a defrost cycle, comprising the steps of:

during the first defrost cycle, periodically sensing the voltage being delivered to the heater during said first defrost cycle;

for each voltage sensed, calculating and recording the amount of energy expended during that period;

adding said amounts of energy expended to obtain the total energy expended during the first defrost cycle; and applying said total energy expended to determine the accumulation interval.

2. A method as set forth in claim 1 wherein the step of determining the accumulation interval includes the step of calculating the amount of ice melted during the first defrost cycle.

3. A method as set forth in claim 1 wherein the step of determining the accumulation interval includes the step of calculating an amount of dry-coil de-ice energy expended in the first defrost cycle.

4. A method as set forth in claim 3 wherein the step of determining the accumulation interval includes the additional step of subtracting said dry-coil de-ice energy expended from said total energy expended to obtain the net de-ice energy expended in removing frozen condensate from said evaporator coil.

5. A method as set forth in claim 2 wherein said step of calculating the amount of ice melted is made on the basis of a sensed temperature of air returning to said evaporator coil from a temperature controlled space.

6. A method as set forth in claim 2 wherein said step of calculating the amount of ice melted includes the step of calculating the rate of frozen condensate accumulation during the period between the first and second defrost cycles.

7. A method as set forth in claim 6 wherein said step of calculating the rate of frozen condensate accumulation is accomplished by considering the amount of ice melted during the first defrost cycle and the compressor run time since the first defrost cycle.

8. A method as set forth in claim 6 wherein said accumulation interval is determined on the basis of said rate of frozen condensate accumulation and a predetermined maximum allowable amount of frozen condensate.

9. A method as set forth in claim 1 wherein step of periodically sensing the voltage is accomplished every second.

10. A control system for a refrigeration apparatus having an evaporator coil and an electric defrost heater for applying heat to the evaporator coil during a defrost cycle, comprising:

sensing means for periodically sensing a voltage being delivered to the heater during a defrost cycle;

first calculation means for calculating an amount of energy expended during each of said periods and for adding said amounts to obtain a total amount of energy expended by the defrost heater during the defrost cycle; and second calculating means for calculating an accumulation interval to a next defrost cycle on the basis of said total amount of energy expended.

11. A control system as set forth in claim 10 wherein said first and second calculating means are contained within a controller.

12. A control system as set forth in claim 11 wherein said system includes a temperature sensor for sensing a temperature of the air returning to said evaporator coil from a temperature controlled space.

13. A control system as set forth in claim 12 wherein said controller receives inputs from said temperature sensor.

14. A control system as set forth in claim 10 wherein said second calculating means includes means for determining an amount of ice that is melted during the defrost cycle.

15. A control system as set forth in claim 14 wherein said second calculation means includes means for determining a rate of frozen condensate accumulation following the defrost cycle.

16. A control system as set forth in claim 15 where said rate determining step is accomplished as a function of an amount of ice melted during the defrost cycle and a compressor run time following the defrost cycle.

* * * * *